US005255056A

United States Patent [19]

Preszler et al.

[11] Patent Number: 5,255,056

[45] Date of Patent: Oct. 19, 1993

[54] PHOTOCONDUCTOR FILM CLAMPING AND TENSIONING SYSTEM AND METHOD OF USE

[75] Inventors: Duane A. Preszler, River Falls; Donald L. Knutson, White Bear Lake; Lawrence M. Lucking, Hugo, all of Minn.

[73] Assignee: Minnesota Mining and Manufacturing Co., Saint Paul, Minn.

[21] Appl. No.: 10,482

[22] Filed: Jan. 28, 1993

Related U.S. Application Data

[63] Continuation of Ser. No. 657,645, Feb. 19, 1991, abandoned, which is a continuation-in-part of Ser. No. 511,640, Apr. 20, 1990, abandoned.

[51] Int. Cl.[5] ..... B41F 1/28; G03G 5/00

[52] U.S. Cl. ..... 355/211; 101/415.1; 492/22

[58] Field of Search ..... 355/202, 211, 212, 213, 355/77; 29/118, 121.1, 243.5, 448, 820; 101/415.1; 492/22, 30

[56] References Cited

U.S. PATENT DOCUMENTS

| | | | |
|---|---|---|---|
| 1,038,505 | 9/1912 | Speed | 29/118 |
| 1,614,801 | 1/1927 | Osterlind | 101/415.1 |
| 2,583,546 | 1/1952 | Carlson | 355/211 X |
| 3,276,364 | 10/1966 | Langer | 101/415.1 |
| 3,332,346 | 7/1967 | Luehrs | 101/415.1 |
| 3,584,580 | 6/1971 | Schulz | 101/415.1 |
| 3,880,037 | 4/1975 | Duckett et al. | 83/659 |
| 3,901,188 | 8/1975 | Eberlein | 118/637 |
| 4,006,686 | 2/1977 | Ackerman | 101/415.1 |
| 4,183,652 | 1/1980 | Yanagawa | 355/211 |
| 4,187,752 | 2/1980 | Chesnut | 83/663 |
| 4,191,076 | 3/1980 | Bollmer et al. | 83/13 |
| 4,217,825 | 8/1980 | Bruckner | 101/415.1 |
| 4,337,700 | 7/1982 | Etchell et al. | 101/415.1 |
| 4,357,093 | 11/1982 | Caudill et al. | 355/3 R |
| 4,495,865 | 1/1985 | Kamoda | 101/415.1 |
| 4,587,901 | 5/1986 | Gianfranco | 101/415.1 |
| 4,682,881 | 7/1987 | Komatsubara et al. | 355/10 |
| 4,703,346 | 10/1987 | Bierhoff | 358/75 |
| 4,728,983 | 3/1988 | Zwadlo et al. | 355/4 |
| 4,754,294 | 6/1988 | Kato | 346/160 |
| 4,754,302 | 6/1988 | Komatsubara et al. | 355/4 |
| 4,877,198 | 10/1989 | Gershenson et al. | 242/74 |
| 5,021,829 | 6/1991 | Johnson et al. | 355/213 |
| 5,069,127 | 12/1991 | Iijima et al. | 101/415.1 |
| 5,072,670 | 12/1991 | Bergmann et al. | 101/415.1 |

FOREIGN PATENT DOCUMENTS

| | | | |
|---|---|---|---|
| 0121592B1 | 4/1981 | European Pat. Off. . | |
| 2746065A | 4/1979 | Fed. Rep. of Germany . | |
| 0037751 | 3/1979 | Japan | 355/213 |
| 756867 | 9/1956 | United Kingdom . | |
| 1321028 | 6/1973 | United Kingdom . | |
| 1348469 | 3/1974 | United Kingdom . | |

*Primary Examiner*—A. T. Grimley
*Assistant Examiner*—Nestor R. Ramirez
*Attorney, Agent, or Firm*—Kinney & Lange

[57] ABSTRACT

A clamping and tensioning system for securing a sheet of photoconductor film to an outer circumferential surface of a carrier drum includes a clamp rod mounted to the carrier drum by first and second mounting blocks. The first and second mounting blocks include elongated slots that allow the clamp rod to rotate about its longitudinal axis and further permit linear radial movement of the clamp rod with respect to the carrier drum. The clamp rod includes mounting pins and spring tabs that engage leading and trailing edges of the photoconductor film. The leading and trailing edges of the photoconductor film are releasibly clamped to the clamp rod by a clamp bar. Leaf spring elements associated with the first and second mounting blocks bias the clamp rod radially inward to a first position wherein the photoconductor film extends loosely about the outer surface of the carrier drum. The photoconductor film is tensioned by rotating the clamp rod about its longitudinal axis which in turn winds the leading and trailing edges of the photoconductor film about the clamp rod. As the clamp rod is rotated, it moves radially outward with respect to the carrier drum along the elongated slots against the bias of the leaf spring elements. The clamp rod is held in a second position wherein the sheet of photoconductor film is securely tensioned about the outer surface of the carrier drum by a releasible split clamp collar.

16 Claims, 10 Drawing Sheets

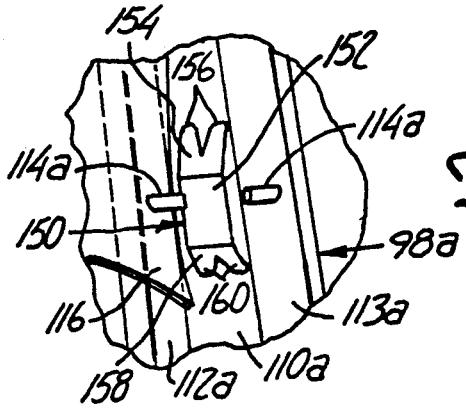
Fig. 15
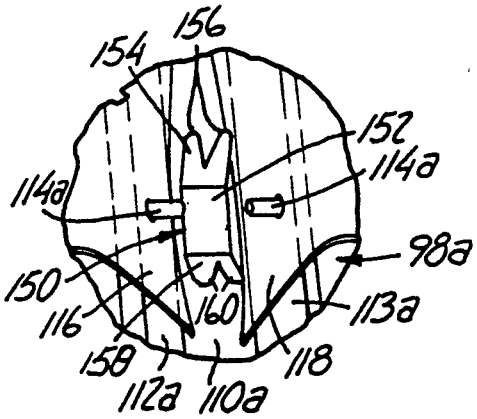
Fig. 16
Fig. 17
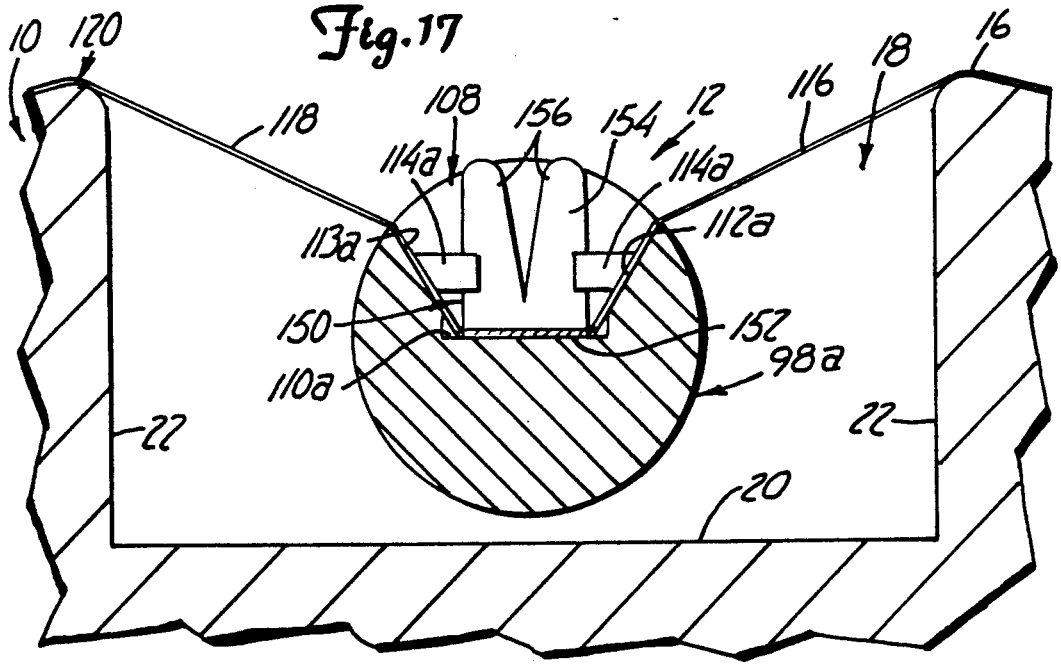

PHOTOCONDUCTOR FILM CLAMPING AND TENSIONING SYSTEM AND METHOD OF USE

This is a continuation of application Ser. No. 07/657,645 filed on Feb. 19, 1991, abandoned as of the date of this application which is a continuation-in-part of application Ser. No. 07/511,640, filed Apr. 20, 1990, now abandoned.

BACKGROUND OF THE INVENTION

This invention pertains generally to multicolor electrographic recording devices. In particular, the present invention is a clamping and tensioning system for securing a sheet of photoconductor film to an outer circumferential surface of a carrier drum.

Typically, to produce a multicolor print a photoconductor film secured to a carrier member of the electrographic recording device is first charged to a uniform potential to sensitize its imaging surface. The charged surface of the photoconductor film is exposed to an image of an original document that is to be reproduced as a multicolor print. This procedure allows the photoconductor film to record an electrostatic latent image corresponding to the informational areas contained within the image of the original document.

To form a multicolor print, successive images of the original document are digitally color separated through different colored filters and recorded on the photoconductor film. These latent images are developed with different colored liquid toners supplied from corresponding toner developing modules of a toner handling network. The color of the liquid toner in a particular developing module corresponds to the subtractive primary of the color of the respective digitally separated image. Electrographic recording is normally done with yellow, cyan and magenta liquid toners. Usually the electrographic recording device also includes a developing module having black liquid toner, since it is required in virtually all commercial color printing applications. The different colored developed images are transferred from the photoconductor film to a print medium in superimposed registration with one another. Heat is usually applied to permanently fuse the image to the print medium to form a completed multicolor print.

A mechanism for securing a photosensitive sheet to an outer surface of a rotary drum is disclosed in U.S. Pat. No. 4,682,881 to Komatsubara et al. The outer surface of the rotary drum includes an image forming section to which the photosensitive sheet is attached and a non image forming section. The image forming section has a plurality of sucking holes arranged along the longitudinal extent of the rotary drum. The sucking holes are connected to a sucking duct through a connecting pipe. A blower coupled to the sucking duct provides vacuum pressure through the sucking holes, and thereby ensures that the photosensitive sheet is firmly secured to the outer surface of the rotary drum during the developing process.

It is evident that there is a continuing need for an improved clamping and tensioning system for securing a sheet of photoconductor film to an outer circumferential surface of a carrier drum. In particular, there is a need for a clamping and tensioning system which permits one person to reliably install and uniformly tension the photoconductor film about the outer surface of the carrier drum. In addition, the clamping and tensioning system should allow the tension in the photoconductor film to be varied depending upon the type and thickness of the particular photoconductor film used in the developing process. Moreover, the clamping and tensioning system should effectively ground the photoconductor film to the carrier drum and should be convenient-to-use.

SUMMARY OF THE INVENTION

The present invention is a convenient-to-use clamping and tensioning system for securely attaching a sheet of photoconductor film to an outer circumferential surface of a carrier drum. The carrier drum includes a U-shaped channel extending along the longitudinal extent of the drum. The U-shaped channel is configured to receive the clamping and tensioning system of the present invention.

A first mounting block is secured to the carrier drum at a first open end of the U-shaped channel. The first mounting block is defined by a bight portion having first and second arms extending outwardly therefrom. A first elongated slot is formed between the first and second arms. A first end of a rotatable clamp rod is received in the first elongated slot for linear movement relative thereto. A second mounting block is secured to the carrier drum adjacent a second closed end of the U-shaped channel. The second mounting is defined by a base having first and second extensions extending outwardly therefrom. The second mounting block includes a second elongated slot formed between the first and second extensions. The second elongated slot receives a second end of the clamp rod for linear movement relative thereto.

The clamp rod includes a clamping groove formed along its longitudinal extent. Angled side walls of the clamping groove each include spaced mounting pins. The mounting pins are configured to extend through mounting apertures formed in leading and trailing edges of the photoconductor film. The leading and trailing edges of the photoconductor film are retained within the clamping groove and on the mounting pins (when the film is being secured and tensioned about the carrier drum) by a clamp bar. The clamp bar includes a series of bolts held within the clamp bar by retaining rings. The clamp bar is received in the clamping groove of the clamp rod and the bolts are engageable with threaded openings formed in a bottom wall of the groove. When tightened, the bolts securely clamp the leading and trailing edges of the photoconductor film to the clamp rod.

Alternatively, the clamping groove of the clamp rod may include a plurality of evenly spaced spring tabs. The spring tabs hold the leading and trailing edges of the photoconductor film within the clamping groove as the film is being initially installed about the carrier drum. In this alternative embodiment, the clamp bar need only be secured to the clamp rod to tension the photoconductor film about the carrier drum.

The first and second arms of first mounting block include first lateral channels. The first lateral channels are configured to receive a plurality of leaf spring elements which are held in the first lateral channels via threaded fasteners. The first and second extensions of the second mounting block also include second lateral channels that are configured to receive leaf spring elements which are secured within the second lateral channels via threaded fasteners. A split clamp collar is retained on the first end of the clamp rod by a pair of E-rings. The split clamp collar includes a guide pin that is received in a guide slot formed in the bight portion of the first mounting block. The interengagement of the guide pin and the guide slot assures that the split clamp collar only moves linearly with the clamp rod and will not rotate therewith. The split clamp collar includes a split clamp screw that can be tightened so that the split clamp collar prevents any rotation of the clamp rod relative to the first and second mounting blocks.

To tension the photoconductor film on the carrier drum, a hex head formed on the first end of the clamp rod is engaged by a wrench and rotated so that the leading and trailing edges of the photoconductor film are wound onto the clamp rod. As the clamp rod is rotated, it moves linearly along the first and second elongated slots, and thereby radially outward relative to the carrier drum. The leaf spring elements in the first and second mounting blocks bias the clamp rod, and thereby resist its outward radial movement. Once a desired tension is reached in the photoconductor film the split clamp screw of the split clamp collar is tightened so as to prevent any further rotation of the clamp rod. In this position, the photoconductor film is clamped and tensioned and ready for the developing process.

This clamping and tensioning system is relatively simple and is convenient-to-use. It allows one person to reliably install and evenly tension the photoconductor film on the outer surface of the carrier drum. In addition, the tension applied to the photoconductor film can be varied by changing the number of leaf spring elements in the first and second mounting blocks, which allows different types and thicknesses of photoconductor film to be used in the developing process. Moreover, the clamp bar contacts the leading edge and the trailing edge of the photoconductor film and thereby more reliably, electrically grounds the photoconductor film to the carrier drum.

BRIEF DESCRIPTION OF THE DRAWINGS

FIGS. 15 and 16 are enlarged perspective views showing the particulars of one of the spring tabs of the embodiment of the clamp rod shown in FIG. 14.

FIG. 17 is a side elevational view partially in section showing the leading and trailing edges of the sheet of photoconductor film engaged with the mounting pins and spring tabs of the embodiment of the clamp rod shown in FIG. 14.

DETAILED DESCRIPTION OF THE PREFERRED EMBODIMENTS

Figure 1:
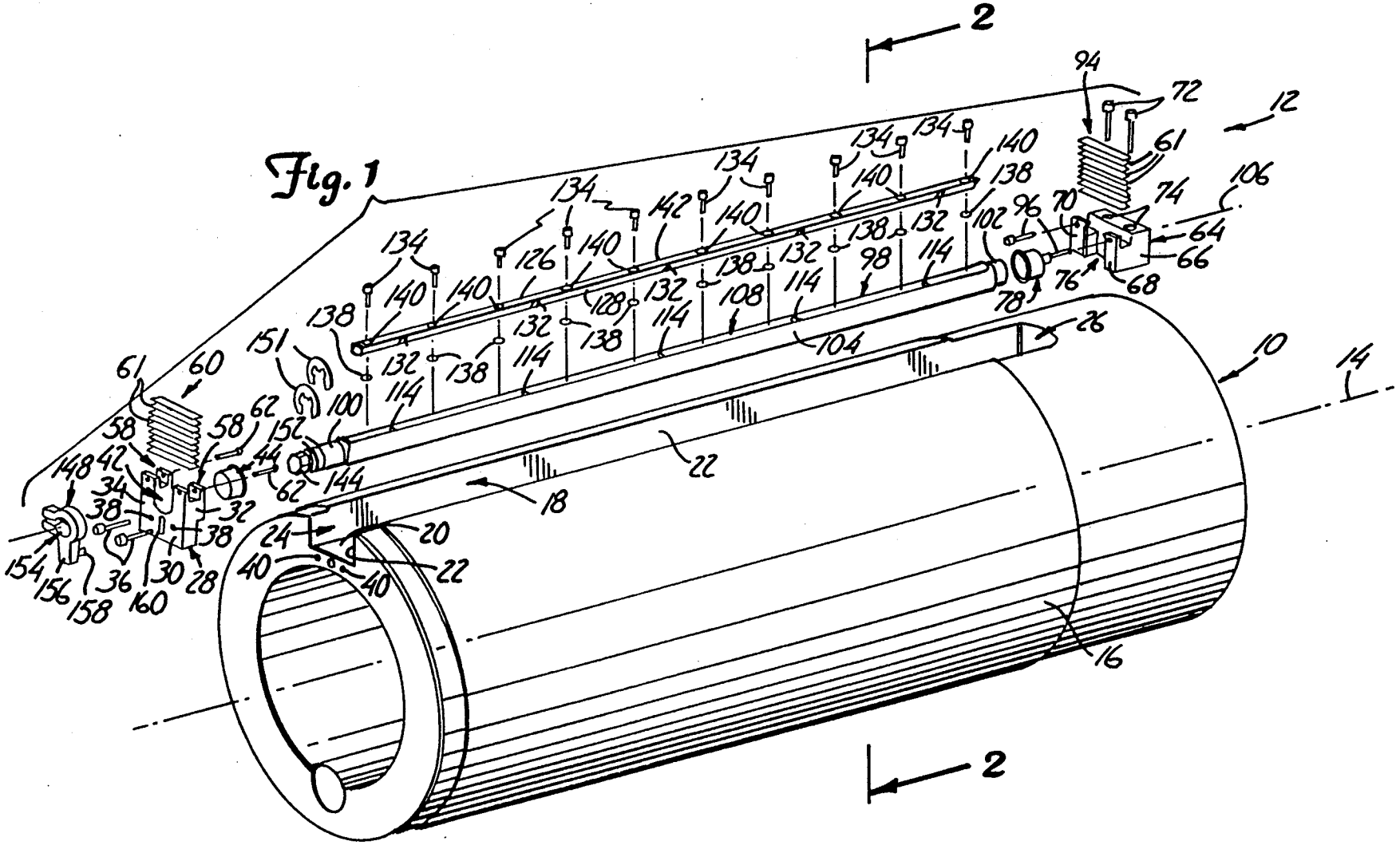
FIG. 1 is an exploded perspective view of the clamping and tensioning system of the present invention.

A carrier drum 10 which includes a clamping and tensioning system 12 in accordance with the present invention is illustrated generally in FIG. The carrier drum is rotatable about a longitudinally extending axis 14 and has an outer circumferential surface 16. A U-shaped channel 18 extends along the outer surface 16 parallel to the axis 14. The U-shaped channel 18 is defined by a base portion 20, a pair of outwardly extending, parallel wall portions 22, a first open end 24 and a second closed end 26.

Figure 2:
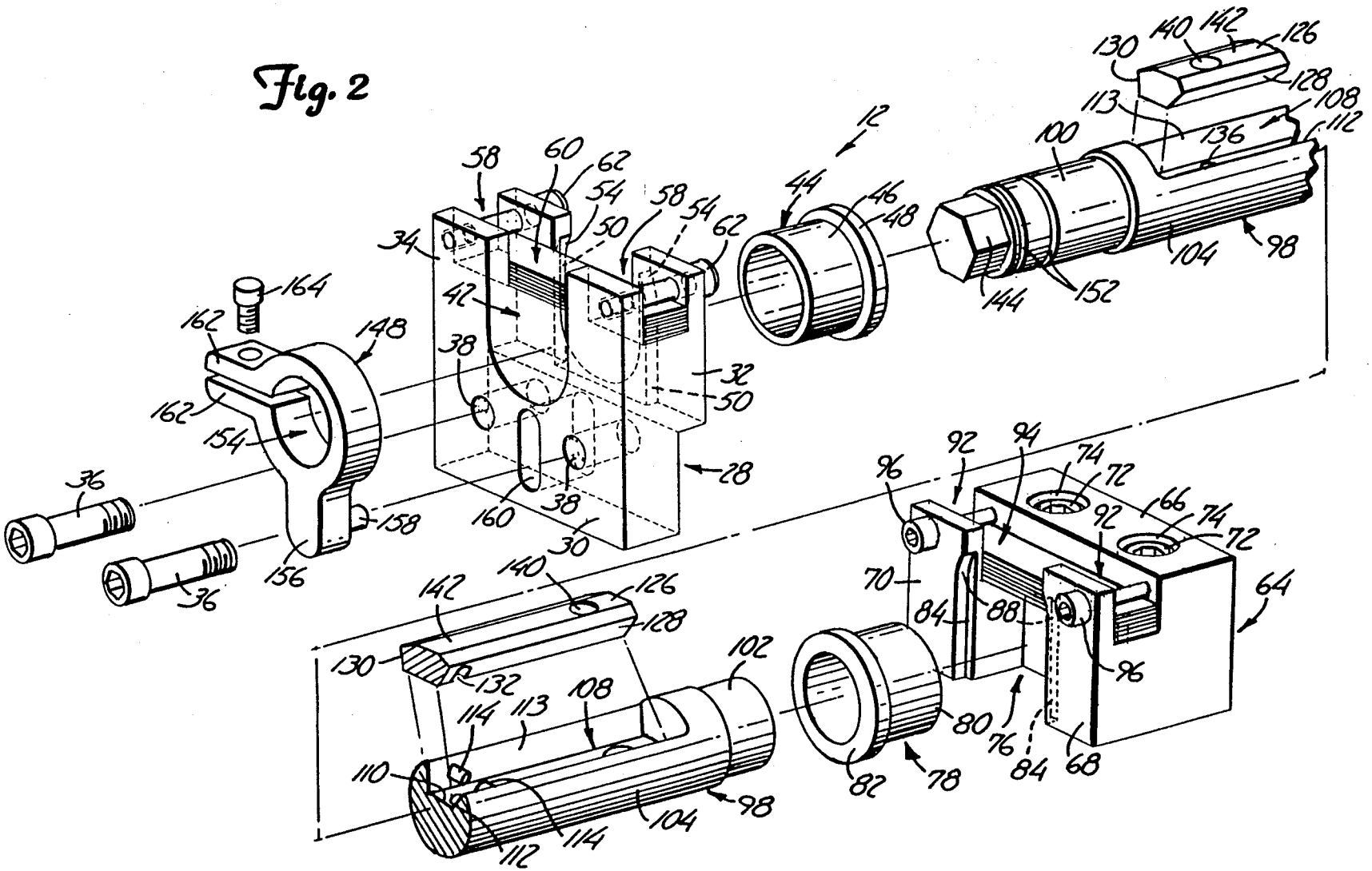
FIG. 2 is an enlarged perspective view showing components of the clamping and tensioning system of FIG. 1.

The U-shaped channel 18 is adapted to house the clamping and tensioning system 12. As seen in FIGS. 1 and 2, the clamping and tensioning system 12 includes a first mounting block 28 defined by a bight portion 30 and first and second outwardly extending arms 32 and 34, respectively. The first mounting block 28 is mounted to the carrier drum 10 at the first open end 24 of the U-shaped channel 18. A pair of threaded fasteners 36 extending through holes 38 formed in the bight portion 30 engage threaded apertures 40 to rigidly secure the first mounting block 28 to the drum 10.

The first mounting block 28 includes a first elongated slot 42 formed between the first and second arms 32 and 34. The first elongated slot 42 supports a first bearing member 44 defined by a cylindrical portion 46 and a flange 48. The cylindrical portion 46 of the first bearing member 44 rides within the first elongated slot 42 for linear movement relative to the first mounting block 28. As seen best in FIG. 2, the flange 48 of the first bearing member 44 rides along a first pair of recessed ridges 50 formed in the first and second arms 32 and 34, respectively. The first pair of recessed ridges 50 include terminal portions 54 that act as mechanical stops and limit outward radial movement of the first bearing member 44 relative to the carrier drum 10. Inward radial movement of the first bearing member 44 relative to the carrier drum 10 is limited by the flange 48 engaging the base portion 20 of the U-shaped channel 18.

As seen in FIGS. 1 and 2, the first and second arms 32 and 34 include first lateral channels 58 that are perpendicular to the first elongated slot 42. The first lateral channels 58 support opposite ends of a first biasing mechanism 60 defined by leaf spring elements 61 (only a few of which are referenced in FIG. 1). As seen in FIG. 2, threaded fasteners 62 extend through the first and second arms 32 and 34 to secure the leaf spring elements 61 of the first biasing mechanism 60 within the first lateral channels 58. The leaf spring elements 61 are engageable by the cylindrical portion 46 of the first bearing member 44 and tend to bias the first bearing member 44 radially inward relative to the drum 10, linearly along the first elongated slot 42 away from the terminal portions 54.

As seen in FIG. 1, The clamping and tensioning system 12 further includes a second mounting block 64 defined by a base 66 and first and second outwardly extending extensions 68 and 70, respectively. The second mounting block 64 is mounted to the carrier drum 10 at the second closed end 26 of the U-shaped channel 18. A pair of threaded fasteners 72 extending through holes 74 formed in the base 66 engage threaded apertures (not shown) in the base portion 20 to rigidly secure the second mounting block 64 to the drum 10.

The second mounting block 64 includes a second elongated slot 76 formed between the first and second extensions 68 and 70. As seen best in FIG. 2, the second elongated slot 76 supports a second bearing member 78 defined by a cylindrical portion 80 and a flange 82. The cylindrical portion 80 of the second bearing member 78 rides within the second elongated slot 76 for linear movement relative to the second mounting block 76. As seen in FIG. 2, the flange 82 of the second bearing member 78 rides along a second pair of recessed ridges 84 formed in the first and second extensions 68 and 70, respectively. The second pair of recessed ridges 84 include terminal portions 88 similar to the terminal portions 54 of the first pair of recessed ridges 50. The terminal portions 88 of the second pair of recessed ridges 84 act as mechanical stops and limit outward radial movement of the second bearing member 78 relative to the carrier drum 10. Inward radial movement of the second bearing member 78 relative to the carrier drum 10 is limited by the flange 82 engaging the base portion 20 of the U-shaped channel 18.

The first and second extensions 68 and 70 include second lateral channels 92 that are perpendicular to the second elongated slot 76. The second lateral channels 92 support opposite ends of a second biasing mechanism 94 defined by leaf spring elements 61. As seen in FIG. 2, threaded fasteners 96 extend through the first and second extensions 68 and 70 to secure the leaf spring elements 61 of the second biasing mechanism 94 within the second lateral channels 92. The cylindrical portion 80 is engageable with the leaf springs 61 of the second biasing mechanism 94 which tend to bias the second bearing member 78 radially inward relative to the drum along the second elongated slot 76 away from the terminal portions 88. As seen in FIG. 1, one embodiment of the clamping and tensioning system 12 includes nine leaf spring elements 61 in the first and second biasing mechanisms 60 and 94. However, the first and second biasing mechanisms 60 and 94 could each include a different number of spring elements 61 depending upon the degree of spring bias desired for the first and second bearing members 44 and 78.

Figure 6:
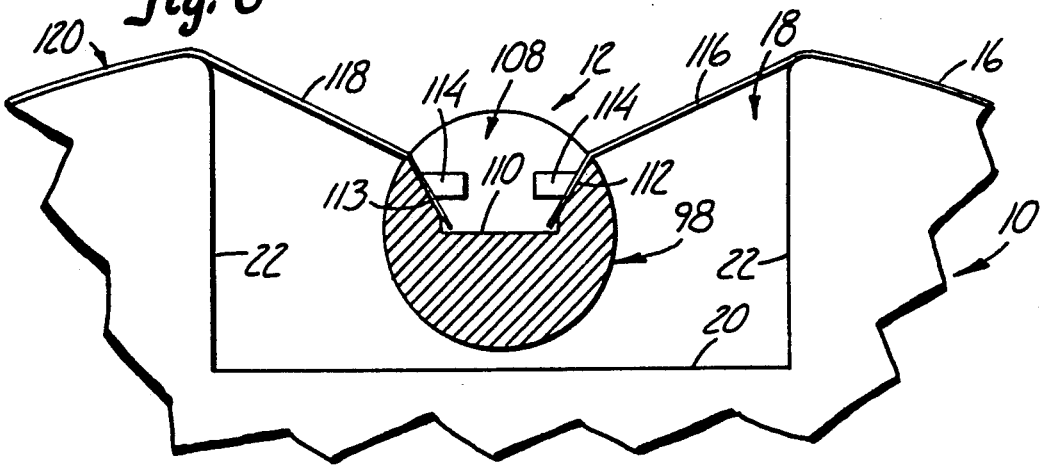
FIG. 6 is a side elevational view partially in section showing the leading and trailing edges of the sheet of photoconductor film engaged with the mounting pins of the clamp rod.

The clamping and tensioning system 12 further includes a clamp rod 98 having a first end 100, a second end 102 and a clamping portion 104 located between the first and second ends 100 and 102. The first and second ends 100 and 102 of the clamp rod 98 are supported for rotation about a longitudinal axis 106 (see FIG. 1) by the first and second bearing members 44 and 78, respectively. In addition, the clamp rod 98 moves with first and second bearing members 44 and 78 linearly along the first and second elongated slots 42 and 76 for inward and outward radial movement relative to the carrier drum 10. As seen best in FIG. 2, the clamping portion 104 includes a longitudinally extending clamping groove 108 defined by a bottom wall 110 and first and second outwardly angled side walls 112 and 113, respectively. The first and second angled side walls 112 and 113 include a plurality of spaced mounting pins 114 (see FIG. 6). The mounting pins 114 extend laterally toward the center of the clamping groove 108 and are parallel to the bottom wall 110. In the embodiment shown in FIG. 1, there are five mounting pins 114 on each of the first and second angled side walls 112 and 113, and the mounting pins 114 on the first angled side wall 112 are in aligned registry with their counterparts on the second angled side wall 113.

Figure 3:
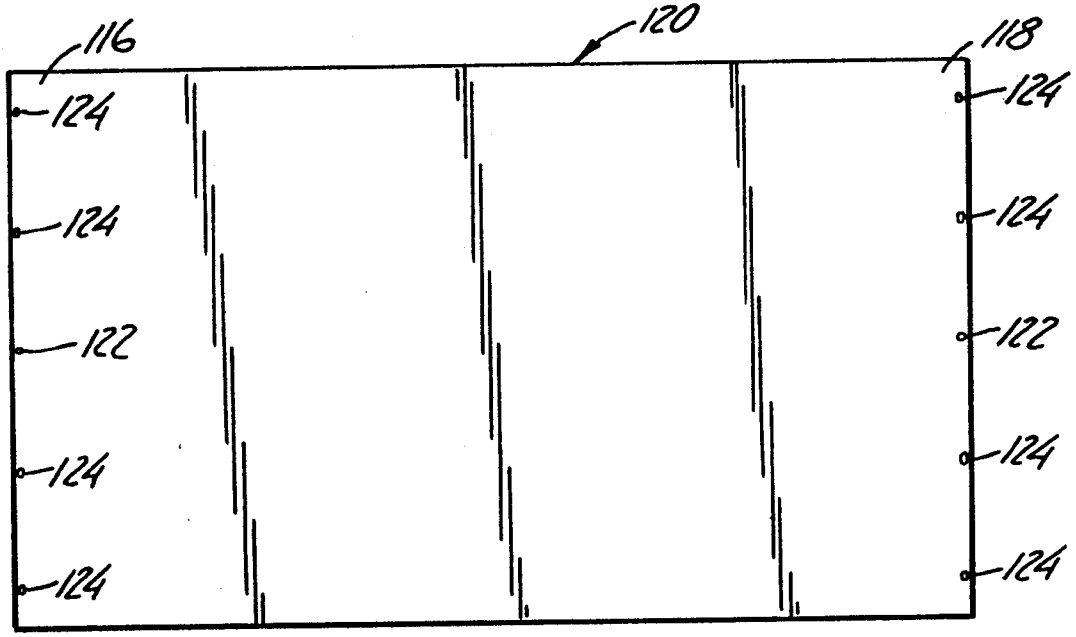
FIG. 3 is a top elevational view of a sheet of photoconductor film.
Figure 4:
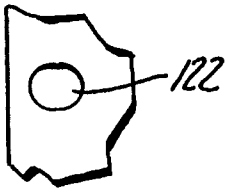
FIG. 4 is an enlarged elevational view showing the particulars of the primary mounting apertures of the sheet of photoconductor film in FIG. 3.

The mounting pins 114 on the first and second angled side walls 112 and 113 are configured to receive a leading edge 116 and a trailing edge 118, respectively, of a sheet of photoconductor film 120. As seen in FIG. 3, the leading and trailing edges 116 and 118 both include primary mounting apertures 122 positioned along the longitudinal centerline of the photoconductor film 120. As seen in FIG. 4, each primary mounting aperture 122 is slightly elongated along the longitudinal extent of the photoconductor film 120. The primary mounting aperture 122 on the leading edge 116 accommodates a center one of the mounting pins 114 on the first side wall 112, while the primary aperture 122 on the trailing edge 118 accommodates a center one of the mounting pins 114 on the second side wall 113.

Figure 5:
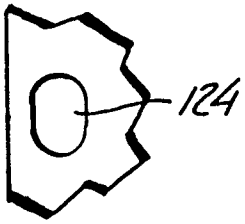
FIG. 5 is an enlarged elevational view showing the particulars of the secondary mounting apertures of the sheet of photoconductor film in FIG. 3.

As seen in FIG. 3, the leading and trailing edges 116 and 118 further include a pair of secondary mounting apertures 124 to either side of the primary mounting apertures 122. As seen in FIG. 5, each secondary mounting aperture 124 is slightly elongated along the longitudinal extent of the photoconductor film 120 and is greatly elongated along the lateral extent of the film 120. The pairs of secondary apertures 124 on the leading and trailing edges 116 and 118 accommodate corresponding mounting pins 114 to either side of the center one of mounting pins 114 one the first and second angled side walls 112 and 113, respectively. The interengagement of the primary and secondary mounting apertures 122 and 124 with the mounting pins 114 allows the photoconductor film 120 to be initially positioned about the carrier drum 10. The primary apertures 122 are shaped differently from the secondary mounting apertures 124 so that the photoconductor film 120 can be initially correctly aligned on the drum 10. The secondary mounting apertures 124 are greatly elongated laterally to provide positioning latitude such that the location of the mounting pins 114 engaged by the secondary mounting apertures 124 relative to the secondary apertures 124 does not have to comply with strict placement parameters. This prevents the photoconductor film 120 from bagging between mounting pins 114 and therefore allows the film 120 to provide a smooth surface to liquid toner developing modules (not shown).

Figure 7:
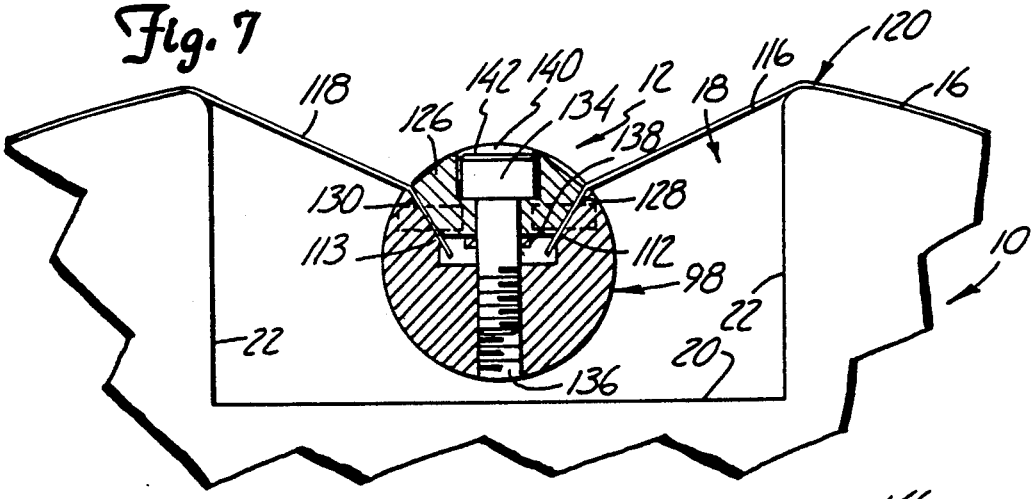
FIG. 7 is a side elevational view partially in section similar to FIG. 6 showing the leading and trailing edges of the sheet of photoconductor film secured to the clamp rod by the clamp bar.

As seen in FIGS. 2 and 7, the leading and trailing edges 116 and 118 are clamped to the clamp rod 98 by a clamp bar 126. The clamp bar 126 includes first and second slanted side walls 128 and 130, respectively, that coact with the first and second angled side walls 112 and 113, respectively. As seen in FIG. 7, the leading and trailing edges 116 and 118 are trapped between the first and second slanted side walls 128 and 130 and the first and second angled side walls 112 and 113 to securely clamp the photoconductor film 120 to the clamp rod 98. The first and second slanted side walls 128 and 130 further include cutouts 132 (see FIGS. 1 and 2) that accommodate the mounting pins 114 and thereby prevent disengagement of the primary and secondary mounting apertures 122 and 124 of the leading and trailing edges 116 and 118 from the mounting pins 114. The clamp bar 126 is secured to the clamp rod 98 by a plurality of bolts 134 (ten of which are shown in FIG. 1) that are threadably received in openings 136 (see FIG. 7) in the bottom wall 110 of the clamping groove 108. As seen in FIG. 1, the bolts 134 are retained on the clamp bar 126 by retaining rings 138 and when tightened the bolts 134 are received in countersunk openings 140 formed in a top surface 142 of the clamp bar 126.

Figure 8:
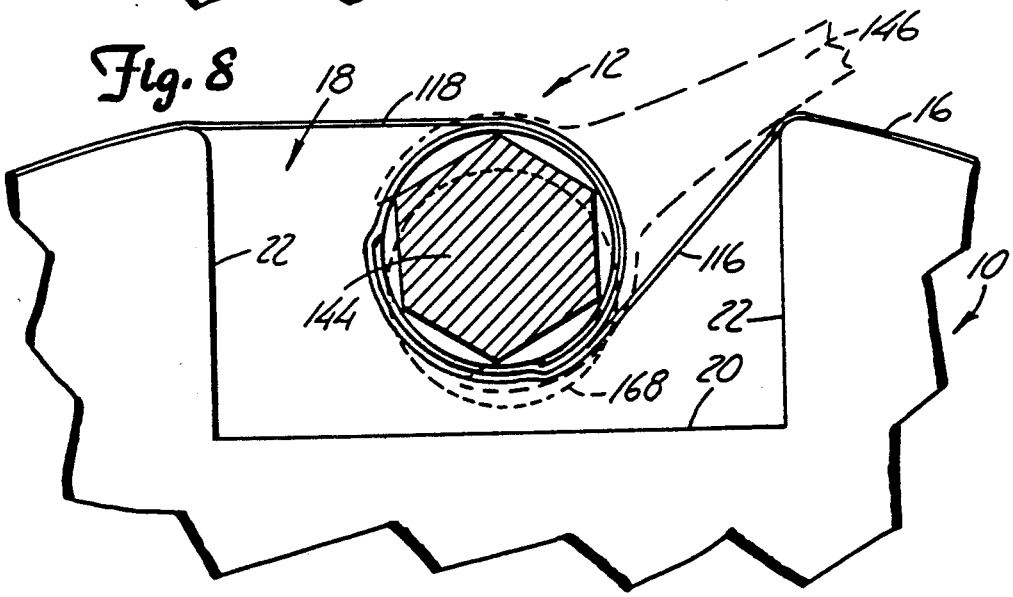
FIG. 8 is a side elevational view partially in section showing the sheet of photoconductor film being tensioned.

As seen in FIGS. I, 2 and 8, the first end 100 of the clamp rod 98 includes a hex head 144 that can be engaged by a wrench 146 (see FIG. 8) to rotate the clamp rod 98 about the longitudinal axis 106. The first end 100 further includes a split clamp collar 148 mounted between the first bearing member 44 and the hex head 144. The split clamp collar 148 is secured against longitudinal movement relative to the clamp rod 98 by a pair of E-clips 150 (See FIG. 1) that engage circumferential grooves 152 in the first end 100 to either side of the split clamp collar 148. The split clamp collar 148 includes a through opening 154 that accommodates the first end 100 of the clamp rod 98. The split clamp collar 148 further includes an extension 156 having a guide peg 158 that engages a guide slot 160 in the bight portion 30. The interengagement of the guide peg 158 and the guide slot 160 prevents the split clamp collar 148 from rotating with the clamp rod 98 but allows outward radial movement with the clamp rod 98 relative to the drum 10. The collar 148 further includes leg portions 162 that threadably receive a split clamp screw 164. The split clamp screw 164 when tightened reduces the size of the through opening 154 and thereby prevents rotation of the clamp rod 98 relative to the first and second mounting blocks 28 and 64.

Figure 14:
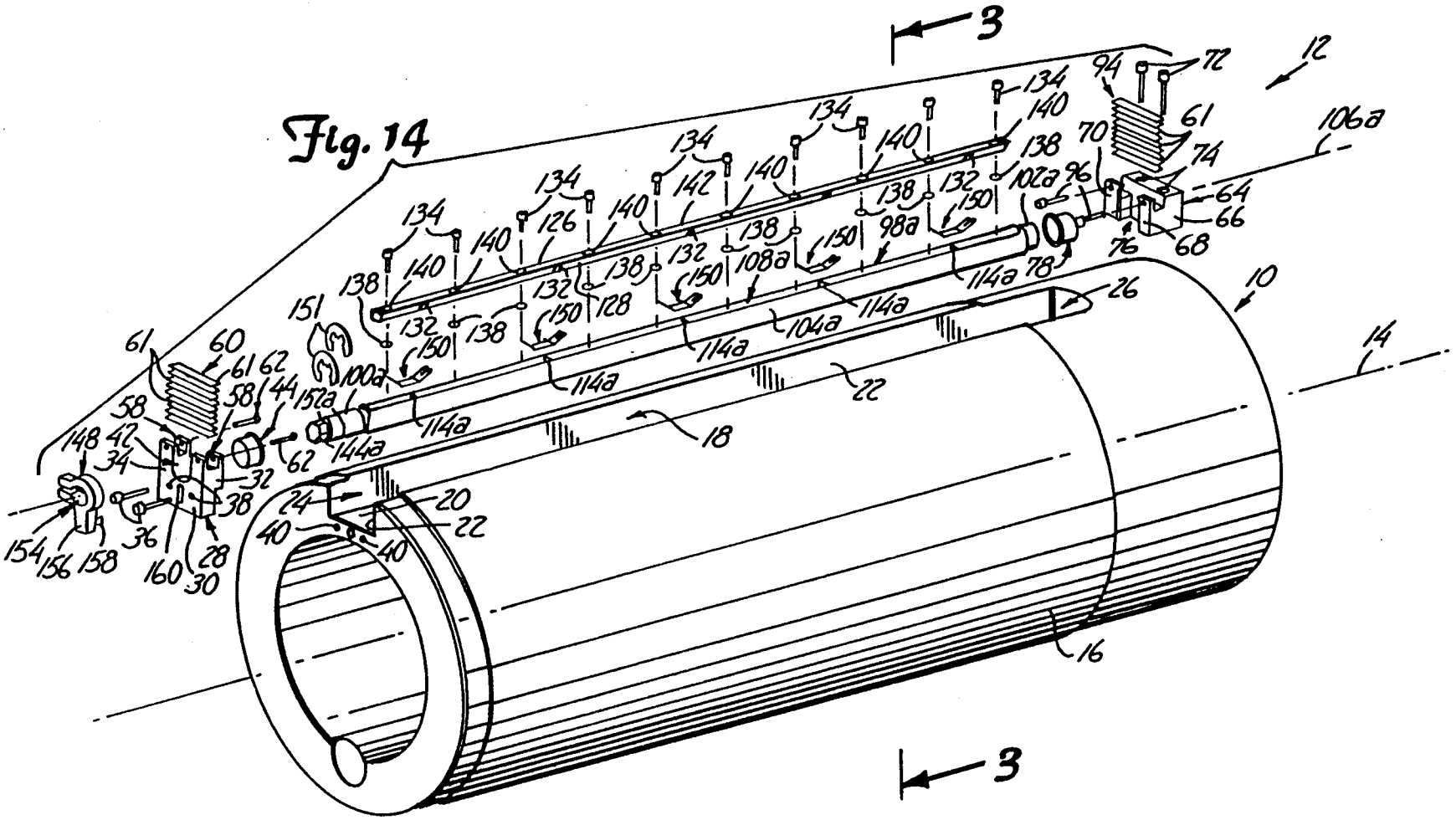
FIG. 14 is an exploded perspective view of the clamping and tensioning system of the present invention showing an alternative embodiment of the clamp rod.

FIG. 14 illustrates an alternative embodiment of the clamp rod **98*a*. The clamp rod 98*a* includes a plurality of spring tabs 150 evenly spaced along the clamping groove 108*a*. Each spring tab 150 has a base portion 152, a first angled end 154 defined by a pair of spring fingers 156 and an oppositely directed second angled end 158 defined by a pair of spring fingers 160. The spring tabs 150 are made of a flexible plastic, such as polyester, which allows the spring fingers 156 and 160 to be flexed relative to their respective base portion 152. Each spring tab 150 is secured to the bottom wall 110*a* of the clamping groove 108*a* by way of an adhesive applied to the base portion 152**.

As seen in FIGS. 15 and 16, one spring tab 150 is positioned beneath each pair of oppositely directed mounting pins **114*a* so that the spring fingers 156 and 160 extend to either side of the mounting pins 114*a*. The spring fingers 156 and 160 are configured to retain the leading and trailing edges 116 and 118 of the photoconductor film 120 within the clamping groove 108*a* as the film 120 is initially installed about the outer circumferential surface 16 of the carrier drum 10**.

OPERATION OF THE CLAMPING AND TENSIONING SYSTEM

Figure 9:
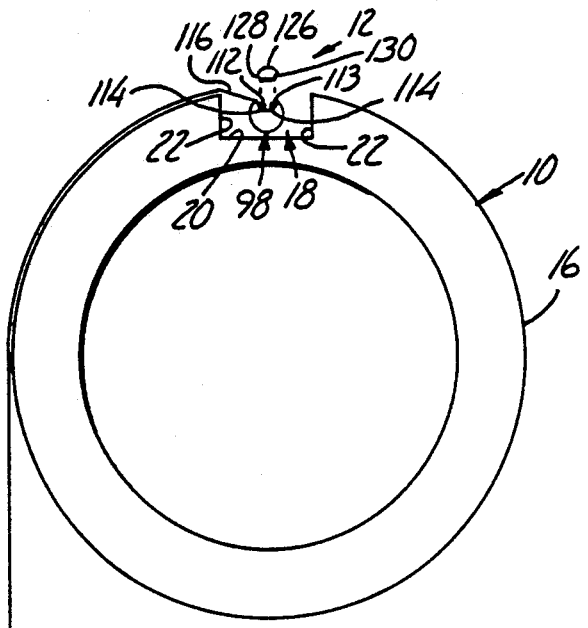
FIGS. 9–13 are sectional views taken along line 2—2 in FIG. 1 illustrating the method of securing the sheet of photoconductor film to the carrier drum using the clamping and tensioning system of the present invention.

To securely attach the sheet of photoconductor film 120 to the outer circumferential surface 16 of the carrier drum 10, the drum 10 is rotated about the longitudinal axis 14 until the clamping and tensioning system 12 is at the twelve o'clock position shown in FIG. 9. The clamp rod 98 is then rotated about the longitudinal axis 106 until the clamping groove 108 is also at the twelve o'clock position as illustrated in FIG. 9. The split clamp screw 164 is tightened to reduce the size of the through opening 154 and thereby lock the split clamp collar 148 to the first end 100 of the clamp rod 98. This procedure prevents the clamp rod 98 from rotating relative to the first and second mounting blocks 28 and 64, respectively, since the interengagement of the guide peg 158 with the guide slot 160 prevents rotation of the split clamp collar 148 relative to the drum 10. However, the clamp rod 98 can still move radially outward relative to the drum 10 since the interengagement of the guide peg 158 with the guide slot 160 permits such movement.

Figure 10:
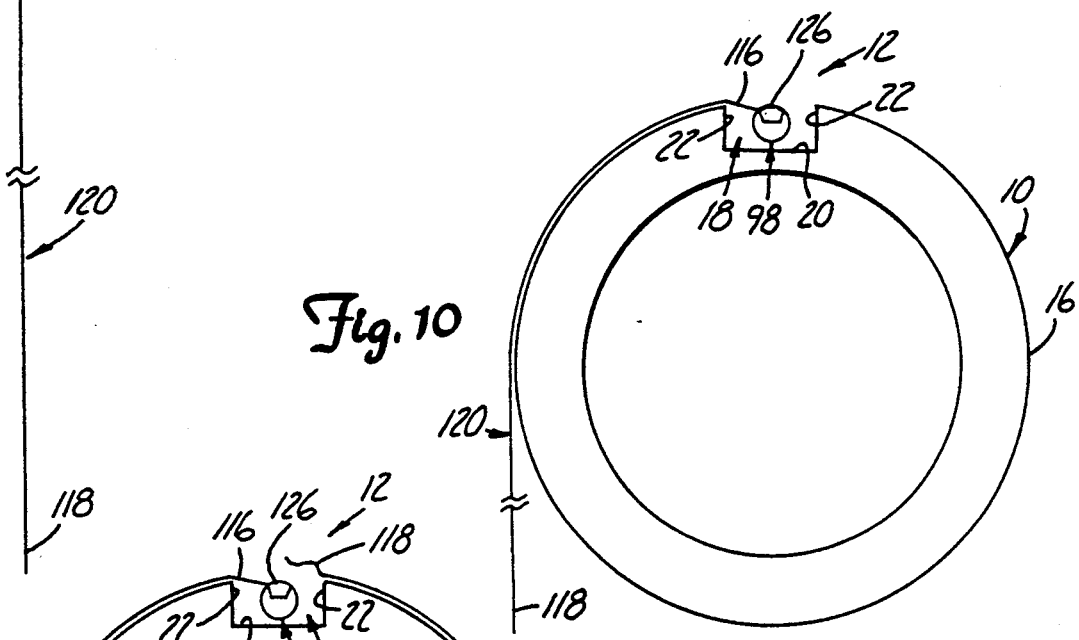

With the clamp bar 126 removed the primary and secondary mounting apertures 122 and 124 of the leading edge 116 can be engaged with the mounting pins 114 on the first angled side wall 112 of the clamping groove 108. As seen in FIG. 10, the clamp bar 126 is then secured to the clamp rod 98 by tightening the bolts 134 which engage the threaded openings 136 in the bottom wall 110 in the clamping groove 108. At this point it is necessary to tighten only every other bolt 134 (i.e., five of the bolts 134). This securely clamps the photoconductor film 120 to the clamp rod 98 by trapping the leading edge 116 between the first slanted side wall 128 of the clamp bar 126 and the first angled side wall 112 of the clamping groove 108. The cutouts 132 in the first slanted side wall 128 accommodate the mounting pins 114 on the first angled side wall 112.

Figure 11:
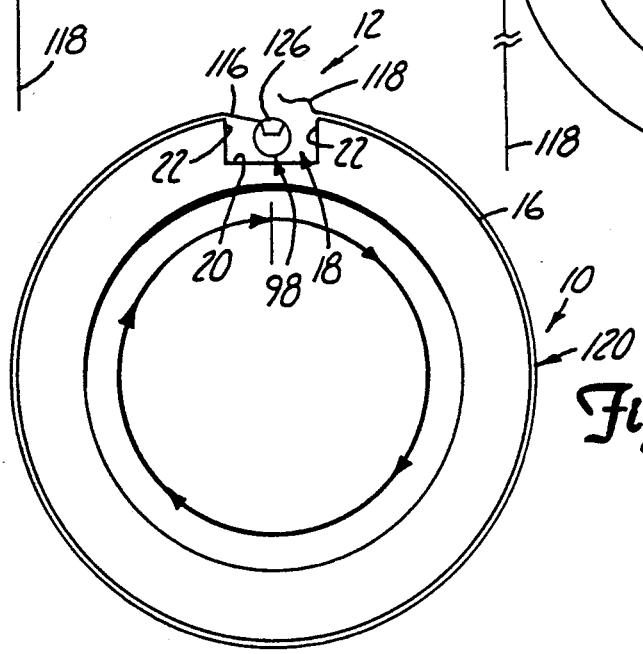
Figure 12:
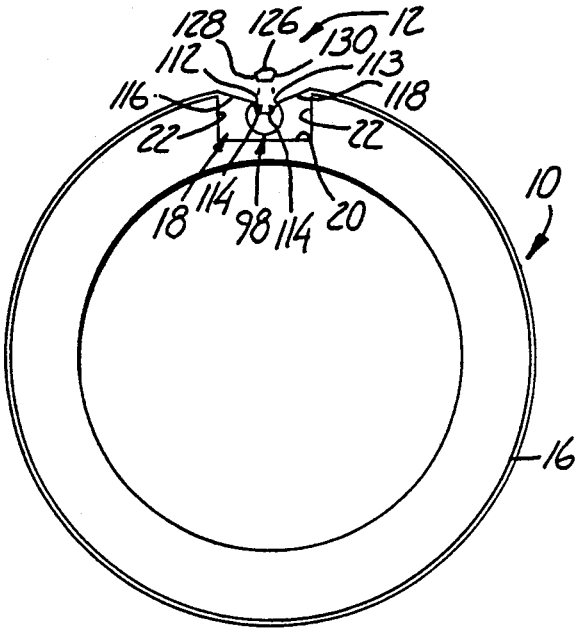
Figure 13:
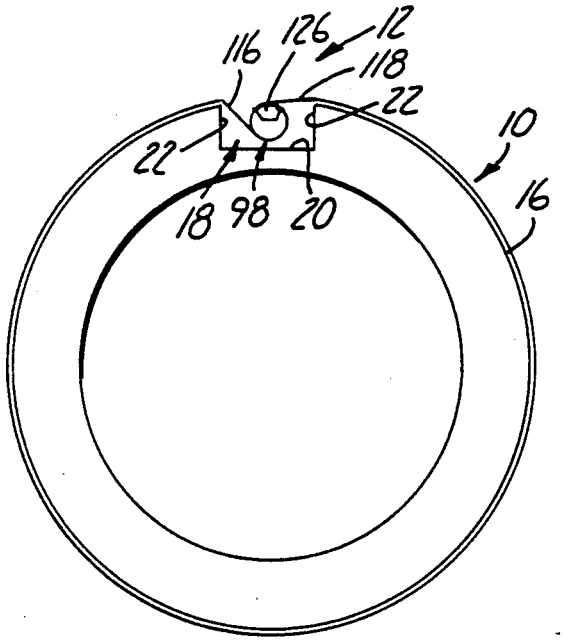

As seen in FIG. 11, the carrier drum 10 is then rotated clockwise (as viewed in FIGS. 9–13) approximately 360 degrees about the longitudinal axis 14. This wraps the photoconductor film 120 about the outer surface 16 of the drum 10 and brings the trailing edge 118 of the film 120 into position adjacent the clamp rod 98. The clamp bar 126 is removed by unfastening the five bolts 134 previously tightened. With the clamp bar 126 removed the primary and secondary apertures 122 and 124 in the trailing edge 118 of the film 120 are engaged with the mounting pins 114 on the second angled side wall 113 of the clamping groove 108 (see FIG. 12). Next, the clamp bar 126 is reinstalled and all ten of the bolts 134 are tightened (see FIGS. 7 and 13). This procedure securely clamps the photoconductor film 120 to the clamp rod 98 by trapping the leading and trailing edges 116 and 118 between the first and second slanted side walls 128 and 130 of the clamp bar 126 and the first and second angled side walls 112 and 113 of the clamping groove 108, respectively. The mounting pins 114 on the first and second angled side walls 112 and 113 are received in the cutouts 132 in the first and second slanted side walls 128 and 130. The wedge engagement of the clamp bar 126 with the clamping groove 108 provides high clamping forces on the leading and trailing edges 116 and 118 of the photoconductor film 120. In turn, these high clamping forces allow high tension forces to be applied to the photoconductor film 120. In addition, the slanted side walls 128 and 130 of the clamp bar 126 contact the photoconductor side of the leading and trailing edges 116 and 118 of the photoconductor film 120, and thereby electrically ground the film 120 to the carrier drum 10. The split clamp screw 164 is then loosened thereby increasing the size of the through opening 154 of the split clamp collar 148 which allows the clamp rod 98 to rotate freely relative to the first and second mounting blocks 28 and 64.

The clamp rod 98 is now in a first position wherein the sheet of photoconductor film 120 is loosely received about the outer surface 16 of the drum 10. In the first position the clamp rod 98 is slightly biased radially inward with respect to the drum 10 by the first and second biasing mechanisms 60 and 94 such that the flanges 48 and 82 of the first and second bearing members 44 and 78, respectively, are in contact with the base portion 20 of the U-shaped channel 18. With the clamp rod 98 in the first position the wrench 146 is engaged with the hex head 144 to rotate the clamp rod 98 clockwise as viewed in FIG. 8 (i.e., counterclockwise as viewed in FIG. 13). By rotating the clamp rod 98 about the longitudinal axis 106 the leading and trailing edges 116 and 118 of the photoconductor film 120 are wound onto the clamp rod 98. Continued rotation of the clamp rod 98 causes the clamp rod 98 to move radially outward with respect to the drum 10 along the first and second elongated slots 42 and 76 of the first and second mounting blocks 28 and 64. This radially outward movement deflects the leaf spring elements 61 in the first and second mounting blocks 28 and 64 which increases the tension on the photoconductor film 120 about the outer surface 16 of the drum 10. Continued rotation of the clamp rod 98 causes the flanges 48 and 82 of the first and second bearing members 44 and 78 to contact the terminal portions 54 and 88 of the first and second recessed ridges 50 and 84 which stop the outward radial movement of the clamp rod 98. During the outward radial movement the split clamp collar 148 moves with the clamp rod 98 but is prevented from rotating due to the interengagement of the guide peg 158 with the guide slot 160. With the flanges 48 and 82 of the first and second bearing members 44 and 78 engaged with the terminal portions 54 and 88, the clamp rod 98 is rotated slightly counterclockwise (as viewed in FIG. 8) to remove the first and second bearing members 44 and 78 from contact with the terminal portions 54 and 88. Next, the split clamp screw 164 is retightened to prevent rotation of the clamp rod 98. The clamp rod 98 is now in a second position (see FIG. 13) wherein the sheet of photoconductor film 120 is in a clamped and tensioned state about the outer surface 16 of the carrier drum 10.

The tension applied to the photoconductor film 120 through the clamp rod 98 can be varied by changing the number of leaf spring elements 61 in the first and second biasing mechanisms 60 and 94. In addition, the interengagement of the clamp bar 126 and the clamp rod 98 allows the photoconductor film 120 to be uniformly and evenly tensioned about the outer surface 16 of the drum 10. In application, the tensional forces applied to the leading edge 116 of the photoconductor film 120 are substantially opposite to the tensional forces applied to the trailing edge 118 of the film 120, which thereby prevents deflection of the clamp rod 98 and the attendant uneven tension in the film 120. By wrapping the leading and trailing edges 116 and 118 of the photoconductor film 120 about the clamp rod 98, increased pressure is applied to the clamp bar 126 which increases clamping forces between the clamp rod 98 and clamp bar 126. This increased clamping pressure allows greater tension forces to be applied to the photoconductor film 120.

To remove the photoconductor film 120 from the drum 10 the split clamp screw 164 is loosened which causes the clamp rod 98 to move from the second position to the first position due to the spring bias of the leaf spring elements 61. During this movement the clamp rod 98 rotates counterclockwise (as viewed in FIG. 8) and the leading and trailing edges 116 and 118 are unwound. Next, the leading edge 116 is pulled to unwind the clamp rod 98 further until the clamp rod 98 looks like FIG. 7. The clamp bar 126 is removed by loosening the bolts 134 and the leading and trailing edges 116 and 118 are removed from the mounting pins 114. The photoconductor film 120 is then pulled off of the outer surface 16 of the drum 10. The photoconductor film 120 is replaced after approximately fifty images are developed thereon.

Figures 18, 19:
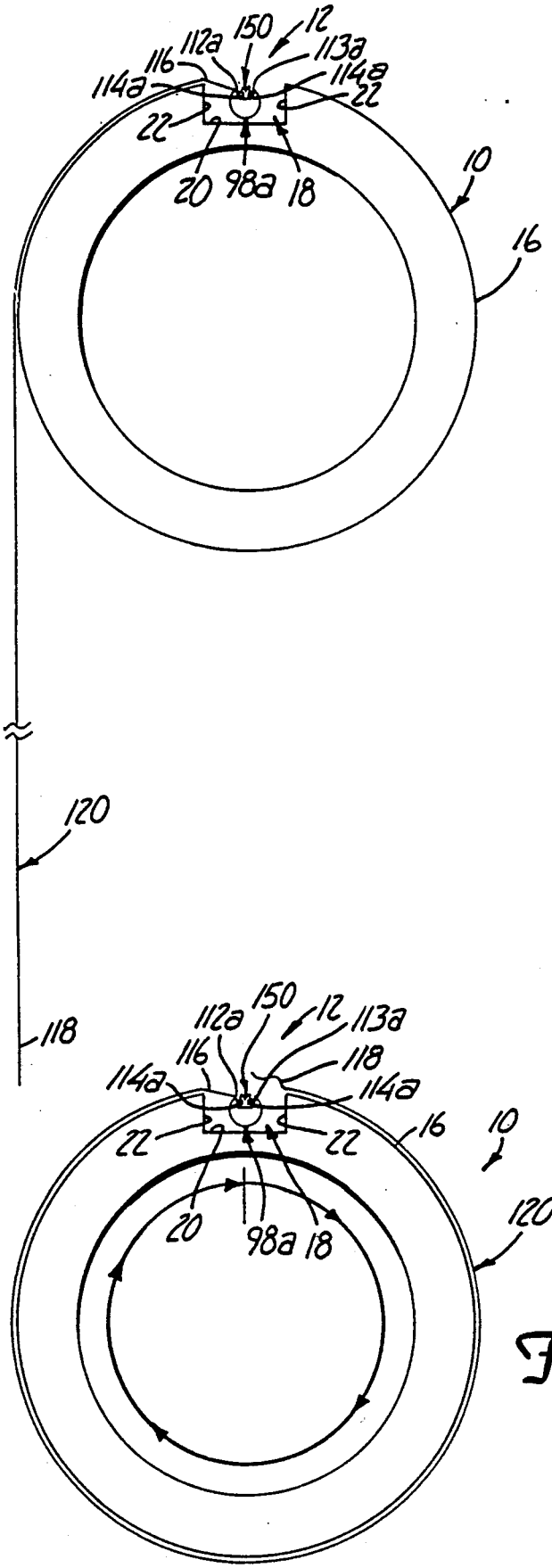
FIGS. 18–21 are sectional views taken along line 3—3 in FIG. 14 illustrating the method of securing the sheet of photoconductor film to the carrier drum using the clamping and tensioning system that includes the alternative embodiment of the clamp rod.
Figure 20:
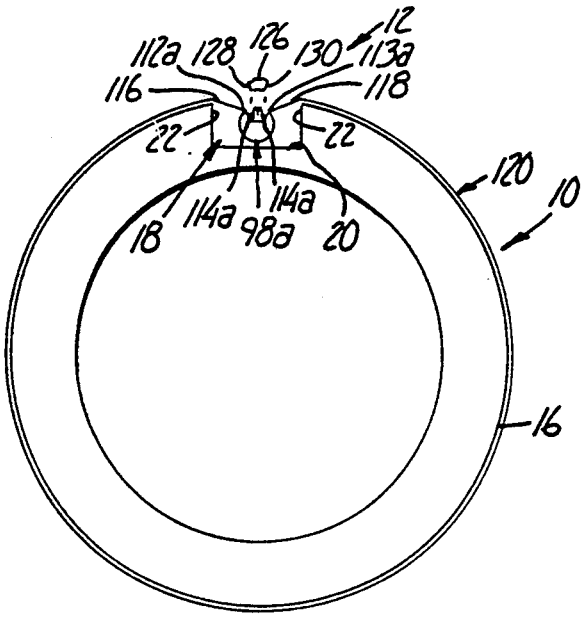
Figure 21:
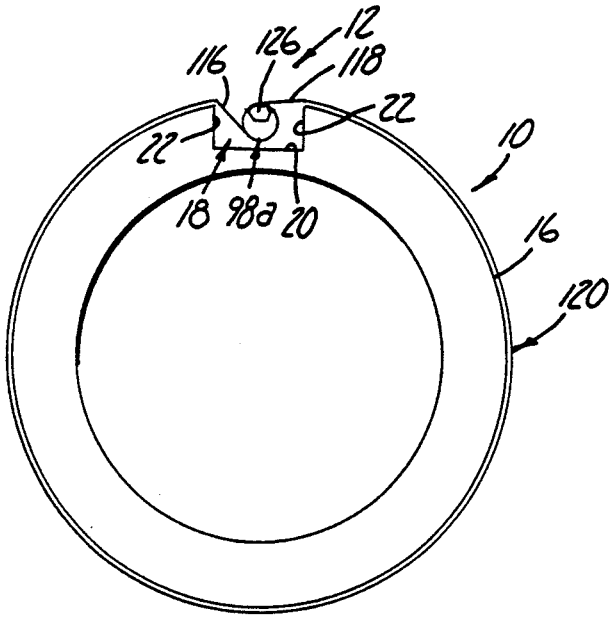

FIGS. 18–21 illustrate an alternative method of securing the sheet of photoconductor film 120 to the outer circumferential surface 16 of the carrier drum 10 using the clamp rod 98*a*. In the alternative method, the drum 10 is rotated about the longitudinal axis 14 until the clamping and tensioning system 12 is at the twelve o'clock position shown in FIG. 18. The clamp rod 98*a* is then rotated about the longitudinal axis 106*a* until the clamping groove 108*a* is also at the twelve o'clock position as illustrated in FIG. 18. The split clamp screw 164 is tightened to reduce the size of the through opening 154 and thereby lock the split clamp collar 148 to the first end 100*a* of the clamp rod 98*a*. This procedure prevents the clamp rod 98*a* from rotating relative to the first and second mounting blocks 28 and 64, respectively, since the interengagement of the guide peg 158 with the guide slot 160 prevents rotation of the split clamp collar 148 relative to the drum 10. However, the clamp rod 98*a* can still move radially outward relative to the drum 10 since the interengagement of the guide peg 158 with the guide slot 160 permits such movement.

With the clamp bar 126 removed, the primary and secondary mounting apertures 122 and 124 of the leading edge 116 can be engaged with the mounting pins 114*a* on the first angled side wall 112*a* of the clamping groove 108*a*. As seen in FIGS. 15 and 18, the leading edge 116 of the photoconductor film 120 is held within the clamping groove 108*a* by the spring fingers 156 and 160 of the spring tabs 150. The spring fingers 156 and 160 act to maintain the interengagement of the primary and secondary mounting apertures 122 and 124 with the mounting pins 114*a*.

As seen in FIG. 19, the carrier drum 10 is then rotated clockwise (as viewed in FIGS. 18–21) approximately 360 degrees about the longitudinal axis 14. This wraps the photoconductor film 120 about the outer surface 16 of the drum 10 and brings the trailing edge 118 of the film 120 into position adjacent the clamp rod 98*a*. Next, the primary and secondary apertures 122 and 124 in the trailing edge 118 of the film 120 are engaged with the mounting pins 114*a* on the second angled side wall 113*a* of the clamping groove 108*a* (see FIGS. 16, 17 and 20). The trailing edge 118 of the film 120 is held within the clamping groove 108*a* by way of the spring fingers 156 and 160 of the spring tabs 150 in the same manner as the leading edge 116 of the film 120 is held within the clamping groove 108*a*.

Next, the clamp bar 126 is installed by tightening all ten of the bolts 134 which engage the threaded openings 136*a* (See FIG. 17) in the bottom wall 110*a* of the clamping groove 108*a*. This procedure securely clamps the photoconductor film 120 to the clamp rod 98*a* by trapping the leading and trailing edges 116 and 118 between the first and second slanted side walls 128 and 130 of the clamp bar 126 and the first and second angled side walls 112*a* and 113*a* of the clamping groove 108*a*, respectively. The mounting pins 114*a* on the first and second angled side walls 112*a* and 113*a* are received in the cutouts 132 in the first and second slanted side walls 128 and 130. The clamp bar 126 flexes the spring fingers 156 and 160 such that they lie against the bottom wall 110*a* of the clamping groove 108*a*.

As in the first method embodiment, the wedge engagement of the clamp bar 126 with the clamping groove 108*a* provides high clamping forces on the leading and trailing edges 116 and 118 of the photoconductor film 120. In turn, these high clamping forces allow high tension forces to be applied to the photoconductor film 120. In addition, the slanted side walls 128 and 130 of the clamp bar 126 contact the photoconductor side of the leading and trailing edges 116 and 118 of the photoconductor film 120, and thereby electrically ground the film 120 to the carrier drum 10.

Next, the split clamp screw 164 is then loosened thereby increasing the size of the through opening 154 of the split clamp collar 148 which allows the clamp rod 98*a* to rotate freely relative to the first and second mounting blocks 28 and 64. The clamp rod 98*a* is now in a first position wherein the sheet of photoconductor film 120 is loosely received about the outer surface 16 of the drum 10. The rest of the procedural steps in the alternative method of securing the film 120 to the outer circumferential surface 16 of the drum 10 (see FIG. 21) and removing the film 120 from the drum 10 parallel those of the first method embodiment. The alternative method provides an advantage over the first method embodiment since the alternative method does not require the use of the clamp bar 126 to initially install the film photoconductor 120 about the outer circumferential surface 16 of the carrier drum 10. However, the clamp bar 126 is still needed to tension the film 120 about the drum 10.

The clamping and tensioning system 12 is relatively simple and is convenient-to-use. It allows one person to reliably install and evenly tension the photoconductor film 120 on the outer surface 16 of the carrier drum 10. In addition, the tension applied to the photoconductor film 120 can be varied by changing the number of leaf spring elements 61 in the first and second mounting blocks 28 and 64, which allows different types and thicknesses of photoconductor film 120 to be used in the developing process. Moreover, the clamp bar 126 contacts the leading edge 116 and the trailing edge 118 of the photoconductor film 120 and thereby more reliably, electrically grounds the photoconductor film 120 to the carrier drum 10.

Although the present invention has been described with reference to preferred embodiments, workers skilled in the art will recognize that changes may be made in form and detail without departing from the spirit and scope of the invention.

What is claimed is:

1. A clamping and tensioning system for securing a sheet of material to an outer circumferential surface of a drum member, comprising:

a clamp rod movably mounted to the drum member and configured to releasably receive first and second edges of the sheet of material, the clamp rod being radially movable relative to the drum member between an initial state wherein the sheet of material is loosely received about the outer surface of the drum member and the clamp rod is in a first radial position relative to a longitudinal axis of the drum member, and a tensioned state wherein the sheet of material is securely tensioned about the outer surface of the drum member and the clamp rod is in a second radial position relative to the longitudinal axis of the drum member, the second position being different from the first position;

a spring biasing means mounted on the drum member and configured to be engaged by the clamp rod in its tensioned state, the spring biasing means providing a spring biasing force directed generally radially inward toward the longitudinal axis of the drum member that acts to bias the clamp rod away from the second radial position towards the first radial position to securely tension the sheet of material about the outer surface of the drum member; and a clamp collar coupled to the drum member and movably receiving the clamp rod, the clamp collar being adapted to releasably secure the clamp rod in the tensioned state.

2. The clamping and tensioning system of claim 1 wherein the clamp rod includes:

a longitudinally extending groove defined by a bottom wall and a pair of spaced side walls, the side walls including mounting pins that are configured to engage corresponding apertures formed in the first and second edges of the sheet of material to position the sheet of material on the outer surface of the drum member.

3. The clamping and tensioning system of claim 1, and further including:

a clamp bar configured to releasably engage the first and second edges of the sheet of material to secure the sheet of material to the clamp rod.

4. The clamping and tensioning system of claim 3 wherein the sheet of material is a sheet of photoconductor film and wherein the clamp bar electrically grounds the first and second edges of the sheet of photoconductor film to the drum member.

5. The clamping and tensioning system of claim 3 wherein the clamp rod includes:

a longitudinally extending groove defined by a bottom wall and a pair of spaced side walls, the side walls including mounting pins that are configured to engage corresponding apertures formed in the first and second edges of the sheet of material to position the sheet of material on the outer surface of the drum member.

6. The clamping and tensioning system of claim 5 wherein the clamp bar includes a plurality of cutouts that accommodate the mounting pins.

7. The clamping and tensioning system of claim 5 wherein the bottom wall of the longitudinally extending groove includes a plurality of threaded openings, and the clamp bar includes a plurality of threaded fasteners that are configured to engage the threaded openings to releasably fasten the clamp bar to the clamp rod and thereby secure the sheet of material to the clamp rod.

8. The clamping and tensioning system of claim 5 wherein the clamp rod further includes:

a plurality of spring tabs mounted within the longitudinally extending groove for releasably engaging the first and second edges of the sheet of material to secure the sheet of material to the clamp rod.

9. The clamping and tensioning system of claim 1 and further including:

a first mounting block mounted to the drum member and including a first elongated slot for supporting a first end of the clamp rod;

a second mounting block mounted to the drum member and including a second elongated slot for supporting a second end of the clam rod, the first and second elongated slots allowing rotational movement of the clamp rod about its longitudinally extending axis and radial linear movement of the clamp rod relative to the drum member between the initial state and the tensioned state.

10. The clamping and tensioning system of claim 9 wherein the first and second elongated slots each include stop portions that limit movement of the clamp rod past the tensioned state.

11. The clamping and tensioning system of claim 9 wherein the spring biasing means includes:

a first spring biasing mechanism mounted to the first mounting block and a second spring biasing mechanism mounted to the second mounting block, the first and second spring biasing mechanisms acting to bias the clamp rod away from the tensioned state toward the initial state.

12. The clamping and tensioning system of claim 9 wherein the clamp collar includes a guide peg that rides within a guide slot in the first mounting block so as to prevent rotation of the clamp collar with the clamp rod and allow movement of the clamp collar between initial and tensioned states with the clamp rod.

13. The clamping and tensioning system of claim 12 wherein the clamp collar is a split clamp collar and includes:

a through opening for receiving the first end of the clamp rod; and a threaded fastener for varying the size of the through opening between a first size wherein the clamp rod is free to rotate about its longitudinal axis in the initial state, and a second size wherein the clamp rod is secured against rotational movement in the tensioned state.

14. A method of securing a sheet of photoconductor film to an outer circumferential surface of a carrier drum, comprising:

positioning the drum to allow access to a clamp rod;

positioning the clamp rod to allow access to a clamping groove therein;

tightening a split clamp collar to prevent rotation of the clamp rod;

fastening a clamp bar to the clamp rod to secure a leading edge of the photoconductor film within the clamping groove;

rotating the drum in a first direction one revolution to wrap the photoconductor film about the outer surface of the drum;

removing the clamp bar;

reinstalling the clamp bar to secure the leading edge and a trailing edge of the photoconductor film within the clamping groove such that the photoconductor film is loosely received about the outer surface of the drum thereby defining an initial state of the clamp rod;

loosening the split clamp collar to allow rotation of the clamp rod;

rotating the clamp rod in a first direction to wind the leading and trailing edges about the clamp rod and take up slack in the photoconductor film, and thereby cause the clamp rod to move radially outward from the longitudinal axis of the drum to a tensioned state wherein the clamp rod engages a spring biasing means that provides a spring biasing force that is directed generally radially inward toward the longitudinal axis of the drum and acts to bias the clamp rod away from a second radial position towards a first radial position to tension the photoconductor film about the outer surface of the drum; and retightening the split clamp collar to prevent rotation of the clamp rod and thereby securely tension the photoconductor film about the outer surface of the drum.

15. A method of exchanging a first sheet of photoconductor film for a second sheet of photoconductor film, comprising the steps of:

positioning a carrier drum to allow access to a clamp rod;

fastening a leading edge of the first sheet of photoconductor film to the clamp rod;

rotating the drum in a first direction to wrap the first sheet of photoconductor film about an outer circumferential surface of the drum;

fastening a trailing edge of the first sheet of photoconductor film to the clamp rod such that the first sheet of photoconductor film is loosely received about the outer circumferential surface of the drum, thereby defining an initial state of the clamp rod;

rotating the clamp rod in a first direction to wind the leading and trailing edges about the clamp rod and take up slack in the first sheet of photoconductor film, and thereby cause the clamp rod to move radially outward from a longitudinal axis of the drum to a tensioned state wherein the clamp rod engages a spring biasing means that provides a spring biasing force that is directed generally radially inward toward the longitudinal axis of the drum and acts to bias the clamp rod away from the second radial position towards a first radial position to tension the first sheet of photoconductor film about the outer circumferential surface of the drum;

preventing rotation of the clamp rod to thereby securely tension the first sheet of photoconductor film about the other circumferential surface of the drum;

removing the first sheet of photoconductor film from the outer circumferential surface of the drum; and securing a second sheet of photoconductor film to the outer circumferential surface of the drum.

16. The method of claim 15 wherein removing the first sheet of photoconductive film from the outer circumferential surface of the drum includes:

positioning the drum to allow access to the clamp rod;

rotating the clamp rod in a second direction to unwind the leading and trailing edges of the first sheet of photoconductor film from the clamp rod and thereby cause the clamp rod to move radially inward toward the drum from the tensioned state back to the initial state;

removing the leading and trailing edges of the first sheet of photoconductor film from the clamp rod; and removing the first sheet of photoconductor film from around the outer circumferential surface of the drum.

* * * * *